US008789382B2

(12) United States Patent
Ko et al.

(10) Patent No.: US 8,789,382 B2
(45) Date of Patent: Jul. 29, 2014

(54) HEAT PUMP INCLUDING AT LEAST TWO REFRIGERANT INJECTION FLOW PATHS INTO A SCROLL COMPRESSOR

(75) Inventors: Younghwan Ko, Changwon-si (KR); Sangkyoung Park, Changwon-si (KR); Yonghee Jang, Changwon-si (KR); Bumsuk Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 998 days.

(21) Appl. No.: 12/846,638

(22) Filed: Jul. 29, 2010

(65) Prior Publication Data

US 2011/0113808 A1 May 19, 2011

(30) Foreign Application Priority Data

Nov. 18, 2009 (KR) ..... 10-2009-0111605

(51) Int. Cl.

| | |
|---|---|
| ***F25B 29/00*** | (2006.01) |
| ***F25B 27/00*** | (2006.01) |
| ***F25B 43/00*** | (2006.01) |
| ***F25B 39/02*** | (2006.01) |
| ***F25B 41/00*** | (2006.01) |
| ***F25B 41/06*** | (2006.01) |
| ***F25B 1/10*** | (2006.01) |
| ***F25B 1/04*** | (2006.01) |
| ***F25B 30/02*** | (2006.01) |

(52) U.S. Cl.

CPC ..... *F25B 1/10* (2013.01); *F25B 2341/066* (2013.01); *F25B 1/04* (2013.01); *F25B 2400/13* (2013.01); *F25B 2400/23* (2013.01); *F25B 2339/047* (2013.01); *F25B 30/02* (2013.01)

USPC ..... 62/159; 62/238.1; 62/238.7; 62/324.1; 62/324.6; 62/503; 62/504; 62/505; 62/513; 62/527; 62/528

(58) Field of Classification Search

USPC ..... 62/238.7, 238.6, 238.1, 503, 504, 505, 62/512, 513, 527, 528, 324.1, 324.2, 62/324.4, 324.6, 117, 122, 150, 159, 174

See application file for complete search history.

(56) References Cited

U.S. PATENT DOCUMENTS 3,177,674 A * 4/1965 Spofford ..... 62/129
3,188,829 A * 6/1965 Siewert et al. ..... 62/238.6

(Continued)

FOREIGN PATENT DOCUMENTS

JP 2006-258343 A 9/2006
JP 2009-36140 A 2/2009

(Continued)

*Primary Examiner* — Ljiljana Ciric

(74) *Attorney, Agent, or Firm* — McKenna, Long & Aldridge LLP

(57) ABSTRACT

A heat pump including at least two refrigerant injection flow paths into a scroll compressor and a main circuit. The main circuit includes a scroll compressor, a condenser, an expansion valve, a phase separator, and an evaporator for evaporating refrigerant. The scroll compressor is provided with a first refrigerant injection port between an inlet of the scroll compressor and an outlet of the scroll compressor, and a second refrigerant injection port between the inlet and the first refrigerant injection port. A first refrigerant injection flow path is bypassed from the phase separator. An internal heat exchanger is installed between the phase separator and the evaporator. A second refrigerant injection flow path is bypassed between the phase separator and the internal heat exchanger. The second refrigerant injection flow path is passed through the internal heat exchanger.

10 Claims, 8 Drawing Sheets

(56) References Cited

U.S. PATENT DOCUMENTS

| | | | | | |
|---|---|---|---|---|---|
| 3,301,002 | A | * | 1/1967 | McGrath | 62/175 |
| 4,098,092 | A | * | 7/1978 | Singh | 62/238.6 |
| 4,134,274 | A | * | 1/1979 | Johnsen | 62/179 |
| 4,238,933 | A | * | 12/1980 | Coombs | 62/238.7 |
| 4,249,390 | A | * | 2/1981 | Jones | 62/238.7 |
| 4,299,098 | A | * | 11/1981 | Derosier | 62/238.6 |
| 4,399,664 | A | * | 8/1983 | Derosier | 62/238.7 |
| 4,409,796 | A | * | 10/1983 | Fisher | 62/160 |
| 4,492,092 | A | * | 1/1985 | Smorol et al. | 62/181 |
| 4,493,193 | A | * | 1/1985 | Fisher | 62/160 |
| 4,528,822 | A | * | 7/1985 | Glamm | 62/238.7 |
| 4,598,557 | A | * | 7/1986 | Robinson et al. | 62/238.6 |
| 4,646,537 | A | * | 3/1987 | Crawford | 62/238.6 |
| 4,766,734 | A | * | 8/1988 | Dudley | 62/160 |
| 4,787,444 | A | * | 11/1988 | Countryman | 165/48.2 |
| 4,940,079 | A | * | 7/1990 | Best et al. | 165/236 |
| 5,056,329 | A | | 10/1991 | Wilkinson | |
| 5,103,652 | A | | 4/1992 | Mizuno et al. | |
| 5,140,828 | A | * | 8/1992 | Hagita et al. | 62/505 |
| 5,184,472 | A | * | 2/1993 | Guilbault et al. | 62/238.7 |
| 5,211,023 | A | * | 5/1993 | Matsuura | 62/117 |
| 5,211,029 | A | * | 5/1993 | Uselton et al. | 62/324.5 |
| 5,243,827 | A | * | 9/1993 | Hagita et al. | 62/113 |
| 5,253,489 | A | * | 10/1993 | Yoshii | 62/505 |
| 5,269,153 | A | * | 12/1993 | Cawley | 62/180 |
| 5,329,788 | A | * | 7/1994 | Caillat et al. | 62/505 |
| 5,465,588 | A | * | 11/1995 | McCahill et al. | 62/127 |
| 5,467,812 | A | * | 11/1995 | Dean et al. | 165/62 |
| 5,495,723 | A | * | 3/1996 | MacDonald | 62/183 |
| 5,640,854 | A | * | 6/1997 | Fogt et al. | 62/197 |
| 5,651,265 | A | * | 7/1997 | Grenier | 62/260 |
| 5,653,120 | A | * | 8/1997 | Meyer | 62/324.6 |
| 5,669,224 | A | * | 9/1997 | Lenarduzzi | 62/160 |
| 5,722,257 | A | * | 3/1998 | Ishii et al. | 62/505 |
| 5,758,514 | A | * | 6/1998 | Genung et al. | 62/471 |
| 5,802,864 | A | * | 9/1998 | Yarbrough et al. | 62/238.6 |
| 5,848,537 | A | * | 12/1998 | Biancardi et al. | 62/324.6 |
| 5,899,091 | A | * | 5/1999 | Fraser et al. | 62/473 |
| 5,901,563 | A | * | 5/1999 | Yarbrough et al. | 62/238.7 |
| 5,937,670 | A | * | 8/1999 | Derryberry | 62/324.4 |
| 5,996,364 | A | * | 12/1999 | Lifson et al. | 62/196.1 |
| 6,058,727 | A | * | 5/2000 | Fraser et al. | 62/190 |
| 6,070,420 | A | * | 6/2000 | Biancardi et al. | 62/114 |
| 6,253,564 | B1 | * | 7/2001 | Yarbrough et al. | 62/238.7 |
| 6,374,631 | B1 | * | 4/2002 | Lifson et al. | 62/505 |
| 6,389,837 | B1 | * | 5/2002 | Morozumi | 62/324.6 |
| 6,438,980 | B1 | * | 8/2002 | Sakurai et al. | 62/197 |
| 6,481,234 | B2 | * | 11/2002 | Ma et al. | 62/324.1 |
| 6,571,576 | B1 | * | 6/2003 | Lifson et al. | 62/513 |
| 6,615,602 | B2 | * | 9/2003 | Wilkinson | 62/238.7 |
| 6,694,750 | B1 | * | 2/2004 | Lifson et al. | 62/113 |
| 6,698,216 | B2 | * | 3/2004 | Goth et al. | 62/77 |
| 6,701,730 | B2 | * | 3/2004 | Sakurai et al. | 62/197 |
| 6,745,584 | B2 | * | 6/2004 | Pham et al. | 62/228.3 |
| 6,817,205 | B1 | * | 11/2004 | Lifson et al. | 62/117 |
| 6,892,553 | B1 | * | 5/2005 | Lifson et al. | 62/324.1 |
| 6,895,768 | B2 | * | 5/2005 | Sakamoto et al. | 62/196.4 |
| 7,000,423 | B2 | * | 2/2006 | Lifson et al. | 62/324.1 |
| 7,024,877 | B2 | * | 4/2006 | Yap | 62/238.6 |
| 7,251,949 | B2 | * | 8/2007 | Yamanaka et al. | 62/513 |
| 7,647,790 | B2 | * | 1/2010 | Ignatiev et al. | 62/512 |
| 7,690,211 | B2 | * | 4/2010 | Sakurai et al. | 62/197 |
| 7,726,151 | B2 | * | 6/2010 | Manole | 62/513 |
| 7,824,160 | B2 | * | 11/2010 | Nakamura et al. | 62/505 |
| 8,079,229 | B2 | * | 12/2011 | Lifson et al. | 62/238.6 |
| 8,099,977 | B2 | * | 1/2012 | Yamanaka et al. | 62/513 |
| 8,181,478 | B2 | * | 5/2012 | Ignatiev | 62/505 |
| 8,261,574 | B2 | * | 9/2012 | Sato et al. | 62/503 |
| 8,302,413 | B2 | * | 11/2012 | Kawano et al. | 62/159 |
| 8,316,657 | B2 | * | 11/2012 | Lifson | 62/113 |
| 8,381,538 | B2 | * | 2/2013 | Lifson et al. | 62/115 |
| 8,517,087 | B2 | * | 8/2013 | Zeigler et al. | 62/324.6 |
| 8,539,785 | B2 | * | 9/2013 | Jiang et al. | 62/513 |
| 2005/0044865 | A1 | * | 3/2005 | Manole | 62/149 |
| 2014/0041400 | A1 | * | 2/2014 | Cavarretta | 62/238.7 |

FOREIGN PATENT DOCUMENTS

| | | | |
|---|---|---|---|
| KR | 10-0883600 | B1 | 2/2009 |
| WO | 8606798 | A1 | 11/1986 |
| WO | 2007111595 | A1 | 10/2007 |
| WO | 2008105868 | A2 | 9/2008 |

* cited by examiner

HEAT PUMP INCLUDING AT LEAST TWO REFRIGERANT INJECTION FLOW PATHS INTO A SCROLL COMPRESSOR

This application claims priority from Korean Patent Application No. 10-2009-0111605 filed on Nov. 18, 2009, in the Korean Intellectual Property Office, the disclosure of which is incorporated herein by reference in its entirety.

BACKGROUND OF THE INVENTION

1. Field of the Invention

The present invention relates to a heat pump, and more particularly, to a heat pump that performance and efficiency can be improved.

2. Description of the Conventional Art

In general, a heat pump is a device which cools or heats an indoor space by performing compression, condensation, expansion, and evaporation process of refrigerant.

Heat pumps are classified into standard air conditioners which have one indoor unit connected to one outdoor unit and multi-type air conditioners which have a plurality of indoor units connected to at least one outdoor unit. Also, heat pumps further comprise a water heater to supply hot water and a heater to heat a floor by using hot water.

The heat pump comprises a compressor, a condenser, an expansion valve and an evaporator. Refrigerant is compressed at the compressor, is condensed at the condenser, and then is expanded at the expansion valve. The expanded refrigerant is evaporated at the evaporator, and then flows into the compressor.

But, the conventional heat pump has a problem that the cooling/heating performance is not sufficient to cool/heat a room, when cooling/heating load such as outdoor temperature is changed. For example, in the cold area, heating performance is extremely reduced. If the existing heat pump is changed into the new heat pump having larger capacity or an extra pump is added to the existing heat pump, it needs high cost and large space for installing.

SUMMARY OF THE INVENTION

An object of the present invention is to provide a heat pump that cooling and heating performance can be improved.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heat pump comprising: a main circuit which comprises a scroll compressor and a condenser for condensing refrigerant passed through the scroll compressor and an expansion device for expanding refrigerant passed through the condenser and an evaporator for evaporating refrigerant expanded by the expansion device; a first refrigerant injection flow path, which is bypassed at the space between the condenser and the evaporator and is connected to one place between an inlet and an outlet of the scroll compressor; and a second refrigerant injection flow path, which is bypassed at the space between the condenser and the evaporator and is connected to the other place which is unlike the place connected the first refrigerant injection flow path between the inlet and the outlet of the scroll compressor.

In the present invention, the heat pump further comprises a third refrigerant flow path, which is bypassed at the space between the condenser and the evaporator and is disposed to the place between the inlet and the outlet of the scroll compressor and is separated from the first refrigerant flow path and the second refrigerant flow path.

In the present invention, the scroll compressor comprises a fixed scroll which comprises a compression chamber having the inlet and the outlet and a rotary scroll which is disposed to rotate in the compression chamber, and the fixed scroll comprises a first refrigerant injection port which the first refrigerant injection flow path is connected to and a second refrigerant injection port which the second refrigerant injection flow path is connected to.

In the present invention, the expansion device comprises a first expansion device which is disposed between the condenser and the first refrigerant injection flow path, and a second expansion device which is disposed between the second refrigerant injection flow path and the evaporator, and the first refrigerant injection flow path is connected to the space between the first expansion device and the second expansion device, and the second refrigerant injection flow path is connected to the space between the first refrigerant injection flow path and the second expansion device.

In the present invention, any one of the first refrigerant injection flow path and the second refrigerant injection flow path comprises a phase separator which separates refrigerant expanded at the expansion device into liquid refrigerant and vapor refrigerant.

In the present invention, any one of the first refrigerant injection flow path and the second refrigerant injection flow path comprises an internal heat exchanger which exchanges heat of refrigerant expanded at the expansion device; and a refrigerant control valve which throttles refrigerant passed through the internal heat exchanger.

In the present invention, the internal heat exchanger comprises a first refrigerant pipe and a second refrigerant pipe which is formed to surround the first refrigerant pipe, and any one of the refrigerant flowing from the expansion device to the evaporator and the refrigerant injecting into the scroll compressor passes through the first refrigerant pipe and the other refrigerant of those passes through the second refrigerant pipe.

In the present invention, wherein the first refrigerant injection flow path comprises a phase separator which separates the refrigerant expanded at the expansion device into liquid refrigerant and vapor refrigerant, and the second refrigerant injection flow path comprises an internal heat exchanger which exchanges heat of refrigerant passed through the phase separator.

In the present invention, the first refrigerant injection flow path comprises a first heat exchanger which exchanges heat of refrigerant flowing from the expansion device to the evaporator for heat of the refrigerant bypassed from the expansion device to the first refrigerant injection flow path, and a first refrigerant control valve which throttles the refrigerant passing through the first refrigerant injection flow path; and the second refrigerant injection flow path comprises a second heat exchanger which exchanges heat of refrigerant flowing from the expansion device to the evaporator for heat of refrigerant bypassed from the expansion device to the second refrigerant injection flow path, and a second refrigerant control valve which throttles the refrigerant passing through the second refrigerant injection flow path; and the first heat exchanger and the second heat exchanger are formed to one unit.

In the present invention, the heat pump further comprises a triple pipe heat exchanger which comprises a first refrigerant pipe forming the first refrigerant injection flow path, and a second refrigerant pipe surrounding the first refrigerant pipe and forming a passage which the refrigerant expanded at the first expansion device passes through, and a third refrigerant pipe surrounding the second refrigerant pipe and forming the second refrigerant injection flow path.

In the present invention, any one of the first refrigerant injection flow path and the second refrigerant injection flow path comprises a phase separator which separates the refrigerant expanded at the expansion device into the liquid refrigerant and vapor refrigerant, and the other of the first refrigerant injection flow path and the second refrigerant injection flow path comprises an internal heat exchanger which is disposed inside of the phase separator and absorbs the heat generated from the inside of the phase separator.

In the present invention, each of the first refrigerant injection flow path and the second refrigerant injection flow path comprises a first refrigerant control valve and a second refrigerant control valve respectively which throttles the refrigerant injecting into the scroll compressor, and further comprising a controller which controls the opening amount of the first refrigerant control valve and the second refrigerant control valve.

In the present invention, if the heat pump is started, the controller controls that the expansion device is started to open and the first refrigerant control valve and the second refrigerant control valve are closed, and then, if the refrigerant injection is demanded after the start control of the expansion device is finished, the controller controls that the first refrigerant control valve and the second refrigerant control valve are started to open.

In the present invention, the controller controls that at least any one of the first refrigerant control valve and the second refrigerant control valve is selectively opened according to the demand load of the heat pump.

In the present invention, the controller controls that the first refrigerant control valve and the second refrigerant control valve is opened in sequence according to the demand load of the heat pump.

In the present invention, the controller controls that the first refrigerant control valve and the second refrigerant control valve is opened at the same time according to the demand load of the heat pump.

In the present invention, the expansion device comprises a first expansion device which is disposed between the condenser and the first refrigerant injection flow path, and a second expansion device which is disposed between the second refrigerant injection flow path and the evaporator, and further comprising a controller which controls that the opening degree of the second expansion device is larger than or equal to the opening degree of the first expansion device.

In the present invention, the heat pump further comprises a water heater which uses the water heated by the condenser.

In the present invention, the heat pump further comprises a heater which uses the water heated by the condenser.

In another aspect of the present invention, there is provided a heat pump comprising: a main circuit which comprises a scroll compressor and a condenser for condensing refrigerant passed through the scroll compressor and an expansion device for expanding refrigerant passed through the condenser and an evaporator for evaporating refrigerant expanded by the expansion device; a water heater which uses water heated by the condenser; a heater which uses water heated by the condenser; a first refrigerant injection flow path, which is bypassed at the space between the condenser and the evaporator and is connected to a place between an inlet and an outlet of the scroll compressor; a second refrigerant injection flow path, which is bypassed at the space between the condenser and the evaporator and is connected to other place which is unlike the place connected the first refrigerant injection flow path between the inlet and the outlet of the scroll compressor.

As described above, the heat pump according to the present invention comprises a scroll compressor, and injects refrigerant to the scroll compressor by using the first refrigerant injection flow path and the second refrigerant injection flow path. By injecting refrigerant, an efficiency of the heat pump can be improved as compared with non-injection. Thus, a heating performance can be improved also in the extremely cold environmental condition such as the cold area.

Also, because refrigerant is injected twice by using the first refrigerant injection flow path and the second refrigerant injection flow path, heating performance can be improved by increasing the injection flow rate.

Also, the difference between the suction pressure and the discharge pressure of the scroll compressor may be decreased, and thus the reliability and the performance of the scroll compressor can be improved.

Also, the size of a heat pump system can be reduced by simplifying the injection structure of the refrigerant and the scroll compressor.

DETAILED DESCRIPTION OF THE PREFERRED EMBODIMENT

Advantages and features of the present invention, and implementation methods thereof will be clarified through following embodiments described with reference to the accompanying drawings.

The present invention will hereinafter be described in detail with reference to the accompanying drawings in which exemplary embodiments of the invention are shown. A heat pump according to an exemplary embodiment of the present invention will hereinafter be described in detail, taking an air conditioner as an example.

Figure 1:
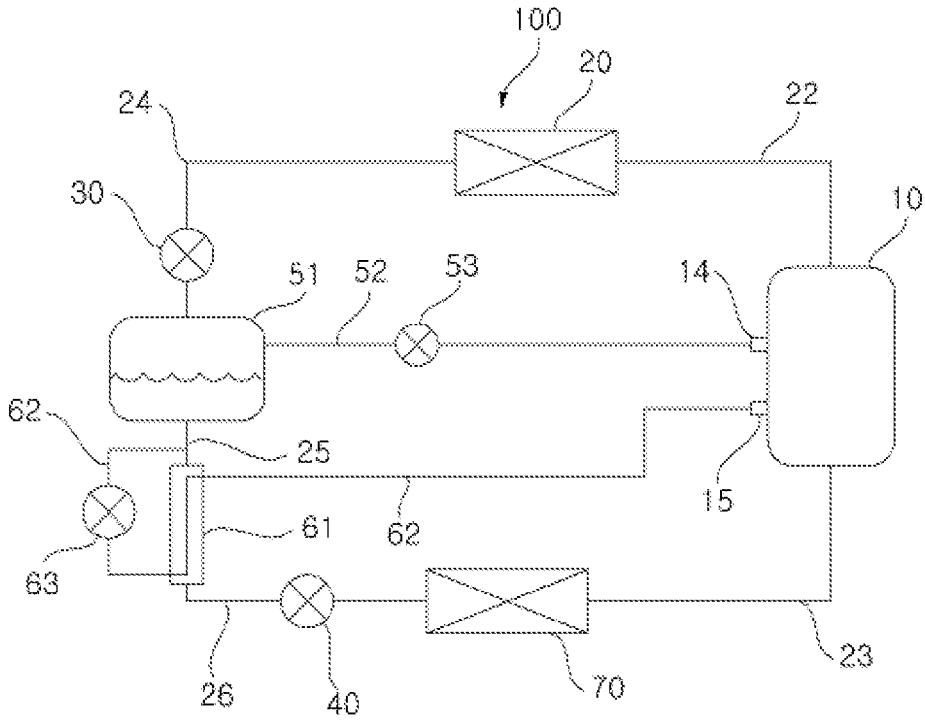
FIG. 1 is a schematic diagram illustrating the configuration of an air conditioner according to a first exemplary embodiment of the present invention.

FIG. 1 is a schematic diagram illustrating the configuration of an air conditioner according to a first exemplary embodiment of the present invention.

Referring to FIG. 1, an air conditioner 100 comprises a main circuit, which comprises a scroll compressor 10 and a condenser 20 for condensing refrigerant passed through the scroll compressor 10 and a first expansion device 30 for expanding refrigerant passed through the condenser 20 and a second expansion device 40 for expanding refrigerant passed through the first expansion device 30 and a evaporator 70 for evaporating refrigerant expanded in the second expansion device 40, and a first refrigerant injection flow path 52 which is bypassed from a space between the condenser 20 and the evaporator 70 and is connected to one side between an inlet and an outlet of the scroll compressor 10, and a second refrigerant injection flow path 62 which is bypassed from a space between the condenser 20 and the evaporator 70 and is connected to the other side between an inlet and an outlet of the scroll compressor 10.

The first expansion device 30 is a first expansion valve 30, which is disposed at a fourth refrigerant circulation flow path 24 stated later and throttles a liquid refrigerant flowing into the inside from the condenser 20.

The second expansion device 40 is a second expansion valve 40, which is disposed at a sixth refrigerant circulation flow path 26 stated later and throttles a liquid refrigerant flowing into the inside from the second refrigerant injection flow path 62.

The condenser 20 is an indoor heat exchanger which is disposed in the indoor and exchanges heat of air and refrigerant. A second refrigerant circulation flow path 22 connects an intake port of the condenser 20 and a discharge port of scroll compressor 10.

The evaporator 70 is an outdoor heat exchanger which is disposed in the outdoor and exchanges heat of air and refrigerant. A third refrigerant circulation flow path 23 connects an intake port of scroll compressor 10 and the evaporator 70.

Figure 2:
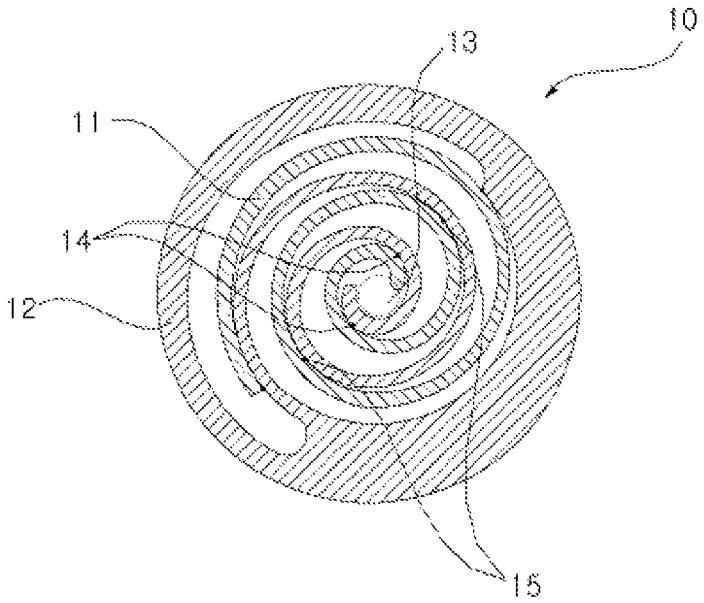
FIG. 2 is a section view illustrating inside of a scroll compressor shown in FIG. 1.

FIG. 2 is a section view illustrating inside of a scroll compressor shown in FIG. 1.

Referring to FIG. 2, the scroll compressor 10 comprises a rotary scroll 11 and a fixed scroll 12, wherein a phase difference of the rotary scroll 11 and the fixed scroll 12 is 180 degree. A compression chamber is formed between an involute wrap of the rotary scroll 11 and an involute wrap of the fixed scroll 12. The compression chamber is shaped into crescent moon by engaging the rotary scroll 11 and the fixed scroll 12, and is a plurality. Refrigerant inside of the compression chamber is gradually compressed and is charged through an outlet 13 by a rotary motion of the rotary scroll 11.

Meanwhile, the first refrigerant injection flow path 52 and the second refrigerant injection flow path 62 respectively injects refrigerant into different place inside of the scroll compressor 10. Namely, the first refrigerant injection flow path 52 may injects refrigerant into any one of a plurality of the compression chambers, and the second refrigerant injection flow path 62 may inject refrigerant into the other of those.

A first refrigerant injection port 14 into which refrigerant injected by the first refrigerant injection flow path 52 flows is formed at the one side of the scroll compressor, and a second refrigerant injection port 15 is formed at the other side of that.

The first refrigerant injection port 14 and the second refrigerant injection port 15 may comprise a hole formed in the fixed scroll 12 or the rotary scroll 11.

Meanwhile, it is not limited the above case, the first refrigerant injection flow path 52 and the second refrigerant injection flow path 62 can be directly connected to a space between the fixed scroll 12 and the rotary scroll 11.

The first refrigerant injection port 14 and the second refrigerant injection port 15 may be respectively two ports, but it also may be one port.

The first refrigerant injection port 14 and the second refrigerant injection port 16 are apart in the direction of the outlet from the inlet of the scroll compressor.

Any one of the first refrigerant injection flow path 52 and the second refrigerant injection flow path 62 may comprise a phase separator 51 for separating refrigerant expanded by the first expansion valve 30 into liquid refrigerant and vapor refrigerant.

The other of the first refrigerant injection flow path 52 and the second refrigerant injection flow path 62 may comprise an internal heat exchanger 61 which is disposed a space between the first expansion valve 30 and the second expansion valve 40 for exchanging heat of refrigerant expanded by the first expansion valve 30.

In the exemplary embodiment of the present invention, it is stated that the first refrigerant injection flow path 52 is the phase separator 52. The first refrigerant injection flow path 52 is connected to the first refrigerant injection port 14.

Also, it is stated that the second refrigerant injection flow path 62 comprises the internal heat exchanger 61. The second refrigerant injection flow path 62 is connected to the second refrigerant injection flow path 15.

The phase separator 51 stores refrigerant temporarily, and separates the stored refrigerant into liquid refrigerant and vapor refrigerant, and then discharges only liquid refrigerant to the outside.

The intake port of the phase separator 51 is connected to a discharge port of the condenser 20 by a fourth refrigerant circulation flow path 24. The discharge port of the phase separator 51 is connected to the internal heat exchanger 61 by a fifth refrigerant circulation flow path 25.

The liquid refrigerant discharged from the phase separator 51 flows into the internal heat exchanger 61 through the fifth refrigerant circulation flow path 25. The vapor refrigerant discharged from the phase separator 51 flows into the first refrigerant injection port 15 of the scroll compressor 10 through the first refrigerant injection flow path 52.

The first refrigerant injection flow path 52 connects the phase separator 51 and the scroll compressor 10.

A first refrigerant control valve 53 is disposed at the first refrigerant injection flow path 52, and throttles the refrigerant passing through the first refrigerant injection flow path 52. The flow rate of refrigerant injected into the first refrigerant injection port 15 can be controlled according to an opening degree of the first refrigerant control valve 53.

A second refrigerant control valve 63 is disposed at the second refrigerant injection flow path 62, and throttles the refrigerant passing through the second refrigerant injection flow path 62. The flow rate of refrigerant injected into the second refrigerant injection port 14 can be controlled according to an opening degree of the second refrigerant control valve 63.

It is possible that the second refrigerant control valve 63 is disposed before the intake port or after the discharge port of the internal heat exchanger 61. In the exemplary embodiment of the present invention, it is stated that the second refrigerant control valve 63 is disposed before the intake port of the internal heat exchanger 61 and throttles refrigerant before refrigerant exchanges heat in the internal heat exchanger.

The second refrigerant injection flow path 62 is bypassed from the fifth refrigerant circulation flow path 25 so that the refrigerant heat-exchanged in the internal heat exchanger 61 is guided to the second refrigerant injection port 14.

The internal heat exchanger 61 exchanges heat of the refrigerant passing through the fifth refrigerant circulation flow path 25 with heat of the refrigerant passing through the second refrigerant injection flow path 62. To achieve the heat exchange, it is possible that the internal heat exchanger 61 may be a plate type heat exchanger or a double pipe type heat exchanger.

Figure 3:
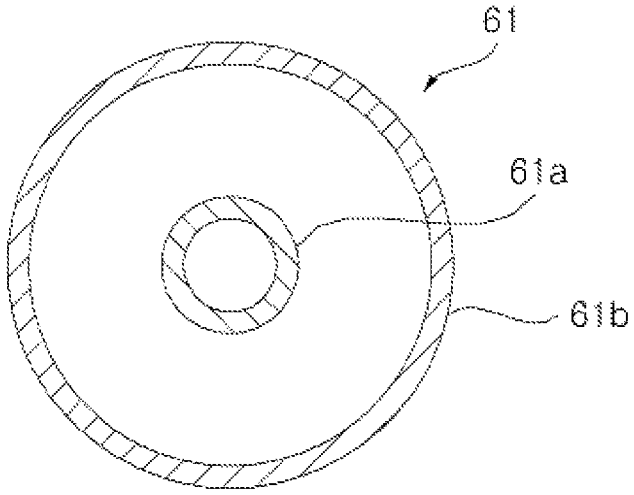
FIG. 3 is a section view illustrating inside of an internal heat exchanger shown in FIG. 1.

FIG. 3 is a section view illustrating inside of an internal heat exchanger shown in FIG. 1.

Referring to FIG. 3, the present invention describes that the internal heat exchanger 61 is a double pipe type heat exchanger which comprises a first refrigerant pipe 61*a* and a second refrigerant pipe 61*b* formed to surround the first refrigerant pipe 61*a*. But, it is also possible that the internal heat exchanger 61 may be a plate type heat exchanger.

The refrigerant of the second refrigerant injection flow path 62 may pass through any one of the first refrigerant pipe 61*a* and the second refrigerant pipe 61*b*, and the refrigerant of the fifth refrigerant circulation flow path 25 may pass through into the other of those.

In the present invention, it describes that the refrigerant of the second refrigerant injection flow path 62 passes through the first refrigerant pipe 61*a* and the refrigerant of the fifth refrigerant circulation flow path 25 passes through the second refrigerant pipe 61*b*.

The discharge port of the internal heat exchanger 61 is connected to the intake port of the evaporator 70 and the sixth refrigerant circulation flow path 26.

Figure 4:
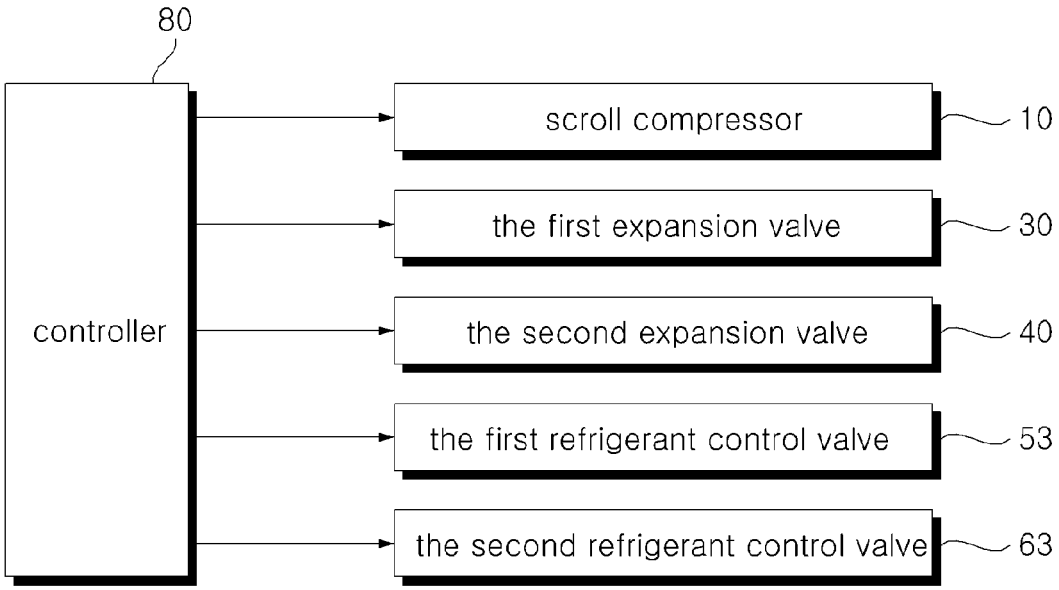
FIG. 4 is a block diagram illustrating the control flow of the air conditioner shown in FIG. 1.

FIG. 4 is a block diagram illustrating the control flow of the air conditioner shown in FIG. 1.

Referring to FIG. 4, the air conditioner 100 further comprises a controller 80 for controlling the overall operation.

The controller 80 controls an opening amount of the first expansion valve 30 and the second expansion valve 40 and the first refrigerant control valve 53 and the second refrigerant control valve 63 according to the heating load of the air conditioner 100.

In the beginning of the operation of the air conditioner 100, the controller 80 controls that the first the first refrigerant control valve 53 and the second refrigerant control valve 63 are closed and that the first expansion valve 30 and the second expansion valve 40 are fully opened. At the beginning of the operation of the air conditioner 100, it can be prevented that liquid refrigerant flows into the scroll compressor device 10 by closing the first refrigerant control valve 53 and the second refrigerant control valve 63.

Meanwhile, if the operation of the gas injection is demanded, it is possible that the controller 80 controls that any one of the first refrigerant control valve 53 and the second refrigerant control valve 63 may be opened selectively, or may be opened in serial order, or may be opened simultaneously for quick reaction, according to the heating load such as the outdoor temperature. The controller 80 can control the opening degree of the first refrigerant control valve 53 and the second refrigerant control valve 63 according to the heating load.

Figure 5:
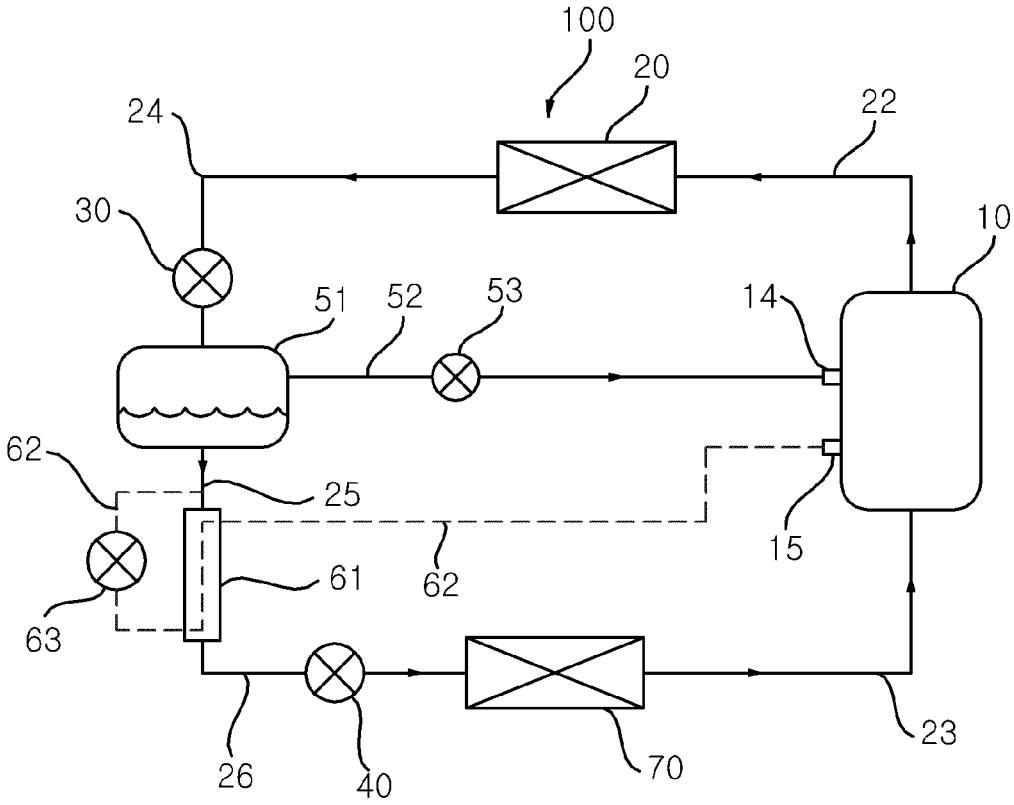
FIG. 5 is a schematic diagram illustrating the condition that a first refrigerant control valve is opened and a second refrigerant control valve is closed in the air conditioner shown in FIG. 1.

FIG. 5 is a schematic diagram illustrating the condition that a first refrigerant control valve is opened and a second refrigerant control valve is closed in the air conditioner shown in FIG. 1.

Figure 6:
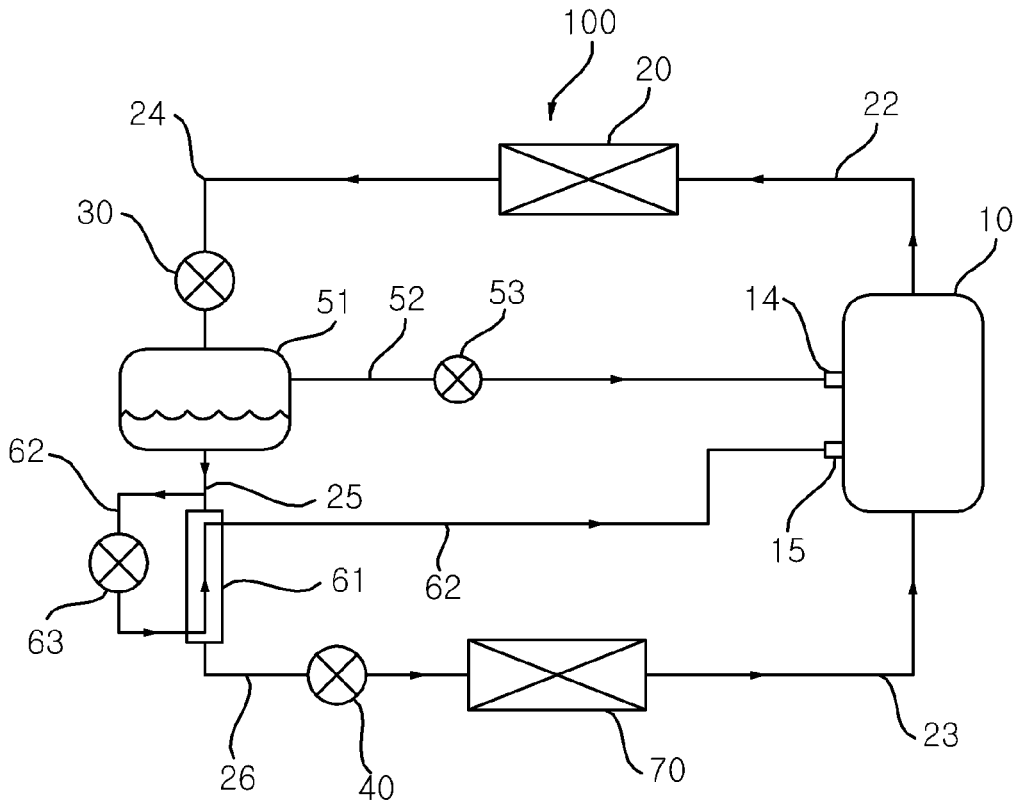
FIG. 6 is a schematic diagram illustrating the condition that a first refrigerant control valve and a second refrigerant control valve are opened in the air conditioner shown in FIG. 1.

FIG. 6 is a schematic diagram illustrating the condition that a first refrigerant control valve and a second refrigerant control valve are opened in the air conditioner shown in FIG. 1.

If the air conditioner 100 is operated, the controller 80 controls the first expansion valve 30 and the second expansion valve 40 to be fully opened.

Meanwhile, the controller 80 controls both the first refrigerant control valve 53 and the second refrigerant control valve 63 to be closed. In the beginning of the operation of the air conditioner 100, it is possible to prevent that liquid refrigerant flows into the scroll compressor 10 through the first refrigerant injection flow path 52 and the second refrigerant injection flow path 62. Therefore, it is able to improve a reliability by closing the first refrigerant control valve 53 and the second refrigerant control valve 63 in the beginning of the operation of the air conditioner 100.

When the operation of the scroll compressor 10 is started, the controller 80 may controls an opening amount of the first expansion valve 30 and the second expansion valve 40 according to the operation of the scroll compressor 10. At this time, the controller 80 has to control that an open degree of the second expansion valve 40 is larger than or equal to an opening degree of the first expansion valve 30.

The controller 80 controls the degree of superheat for the refrigerant of the air conditioner 100 to be reached to the preset target degree of superheat. And the controller also controls for the refrigerant to be reached to the preset intermediate pressure.

The degree of superheat is the difference between the temperature of the refrigerant sucked into the scroll compressor 10 and the saturation temperature with respect to the evaporating pressure of the evaporator 70. The degree of superheat can be measured by a sensor installed in the evaporator 70 and a sensor installed in the inlet of the scroll compressor 10. Generally, the refrigerant passed through the evaporator 70 does not include liquid refrigerant. But, if the load is suddenly changed, the refrigerant may includes liquid refrigerant.

In that case, if the liquid refrigerant flows into the scroll compressor 10, the scroll compressor 10 may become damaged. To prevent the damage of the scroll compressor 10, when the refrigerant passed through the evaporator 70 flows into the scroll compressor 10, the temperature of the refrigerant has to rise so as to eliminate liquid refrigerant. If the amount of refrigerant flowing into the evaporator 70 is decreased, all refrigerants may be evaporated before the refrigerant passes through the evaporator 70. Vapor refrigerants are continuously heated, the degree of superheat may be increased. Therefore, it can be prevented that the liquid refrigerant flows into the scroll compressor 10.

On the other hand, if the amount of the refrigerant flowing into the evaporator 70, the degree of superheat may be decreased.

Therefore, the controller 80 controls an opening amount of the second expansion valve 40 installed between the phase separator 51 and the evaporator 70 so as to control the degree of superheat.

The intermediate pressure is a pressure of inside of the phase separator 51. The intermediate pressure can be calculated from the temperature measured by the temperature sensor installed in the first refrigerant injection flow path 52. By adapting the intermediate pressure to reach a preset intermediate pressure, the work of scroll compressor 10 can be reduced, thus the efficiency of the scroll compressor 10 may be increased. By adjusting the amount of the refrigerant supplied to the phase separator 51 from the condenser 20, the intermediate pressure can be adjusted.

Therefore, the controller 80 adjusts the opening amount of the first expansion valve 30 disposed between the phase separator 51 and the condenser 20 so as to adjust the intermediate pressure.

Meanwhile, if gas injection is demanded, the controller 80 may open any one of the first refrigerant control valve 53 and the second refrigerant control valve 63.

The controller 80 may selects and opens any one of the first refrigerant control valve 53 and the second refrigerant control valve 63 according to the heating load such as the outdoor temperature.

Referring to FIG. 5, if a heating load is below the preset load, the controller 80 may open only the first refrigerant control valve 53 and may close the second refrigerant control valve 63.

If only the first refrigerant control valve 53 is opened, the vapor refrigerant separated by the phase separator 51 flows into the first refrigerant injection port 15 through the first refrigerant flow path 52.

The refrigerant injected into the first refrigerant injection port 15 and the refrigerant in the scroll compressor 10 are mixed and then are compressed. The injected refrigerant is vapor refrigerant at the intermediate pressure. By injecting the refrigerant, a flow rate of the refrigerant passing through the condenser 20 is increased and heating performance can be improved.

Meanwhile, the liquid refrigerant discharged from the phase separator 51 passes through the internal heat exchanger 61. At this time, because the second refrigerant control valve 63 is closed, the heat exchange is not performed in the inside of the internal heat exchanger 61.

Referring to FIG. 6, if the heating load is continuously increased, the controller 80 may also open the second refrigerant control valve 63.

If the second refrigerant control valve 63 is opened, the portion of the liquid refrigerant discharged from the phase separator 51 is bypassed to the second refrigerant injection flow path 62 and then is throttled in the second refrigerant control valve 63 and then flows into the internal heat exchanger 61. Because the temperature and the pressure of the refrigerant throttled by the second refrigerant control valve 63 is dropped, the temperature of the refrigerant throttled is lower than the temperature of the refrigerant flowing in the fifth refrigerant circulation flow path 25.

Therefore, in the internal heat exchanger 61, the refrigerant flowing in the second refrigerant injection flow path 62 and the refrigerant flowing in the fifth refrigerant circulation flow path 25 can exchange the heat of the each. In the internal heat exchanger 61, the refrigerant flowing in the fifth refrigerant circulation flow path 25 lose the heat, the refrigerant flowing in the second refrigerant injection flow path 62 absorbs the heat.

The refrigerant which has lost the heat in the internal heat exchanger 61 is throttled in the second expansion valve 40 and then flows into the evaporator 70. The refrigerant in the evaporator 70 is evaporated by heat exchange with ambient air, and the evaporated refrigerant is introduced into the second refrigerant injection port 14.

Meanwhile, at least some of the refrigerant which absorbs the heat in the internal heat exchanger 61 is evaporated and becomes two phase refrigerant mixed liquid and vapor or superheated vapor refrigerant or vapor refrigerant. The ratio of liquid refrigerant to vapor refrigerant can be minimized by controlling the opening degree of the second refrigerant control valve 63. The flow rate of the refrigerant injected from the internal heat exchanger 61 is more than the flow rate of the refrigerant injected from the phase separator 51. Total flow rate of the refrigerant injecting into the compressor is increased, and thus the heating performance can be improved.

The refrigerant flowed into the second refrigerant injection flow path 62 is injected into the second refrigerant injection port 14 of the scroll compressor 13.

The refrigerant injected into the second refrigerant injection port 14 and the refrigerant in the scroll compressor 10 are mixed and are compressed. Because the injected and compressed refrigerant is the refrigerant at the intermediate pressure, the difference between the suction pressure and the discharge pressure of the scroll compressor 10 can be decreased.

As stated above, because refrigerant is injected twice through the first refrigerant injection flow path 52 and the second refrigerant injection flow path 62, the flow rate can be increased. The heating performance can be improved by an increase of flow rate.

Meanwhile, in the exemplary embodiment of the present invention, it is stated that the heat pump is an air conditioner. However, the present invention is not limited thereto, the heat pump can be applied to a cooling and heating air conditioner comprising a 4-way valve.

Also, in the exemplary embodiment of the present invention, it is stated that the heat pump comprises two refrigerant injection flow paths. However, it is also possible that the heat pump further comprises a third refrigerant injection flow path which is separated from the first refrigerant flow path and the second refrigerant flow path.

Figure 7:
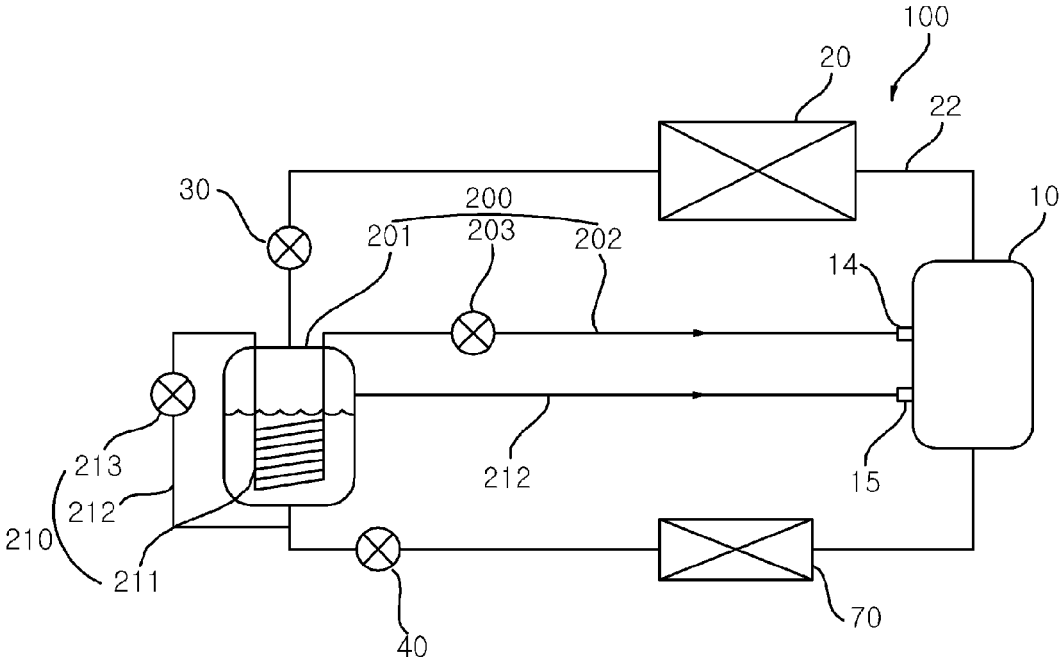
FIG. 7 is a schematic diagram illustrating the configuration of an air conditioner according to a second exemplary embodiment of the present invention.

FIG. 7 is a schematic diagram illustrating the configuration of an air conditioner according to a second exemplary embodiment of the present invention.

Referring to FIG. 7, an air conditioner according to a second exemplary embodiment of the present invention comprises a first injection device 200 and a second injection device 210. The first injection device 200 comprises a phase separator 201 and a first refrigerant injection flow path 202 which is bypassed from the phase separator 201 and connects to the second refrigerant injection port 14 of the scroll compressor 10. The second injection device 210 comprises an internal heat exchanger 211 which is disposed inside of the phase separator 201 and absorbs heat generated from the phase separator 201 and the second refrigerant injection flow path 212 which connects the internal heat exchanger 211 with the first refrigerant injection port 15 of the scroll compressor 10. Detailed description about the same elements as the first exemplary embodiment is skipped. A same number in figures indicates the same element.

A first refrigerant control valve 203 for throttling the injecting refrigerant is disposed at the first refrigerant injection flow path 202.

A second refrigerant control valve 213 for throttling the injecting refrigerant is disposed at the second refrigerant injection flow path 212.

Because the phase separator 201 and the internal heat exchanger 211 are formed to one unit, the structure can be simplified. Also, the heat generated from the phase separator 201 can be utilized.

Figure 8:
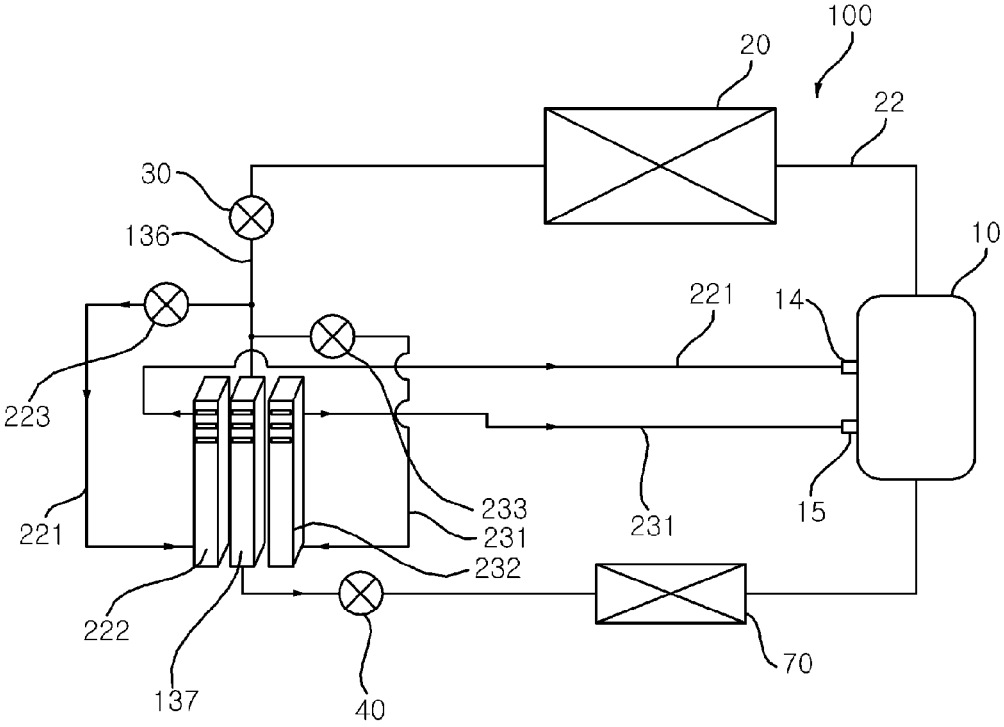
FIG. 8 is a schematic diagram illustrating the configuration of an air conditioner according to a third exemplary embodiment of the present invention.

FIG. 8 is a schematic diagram illustrating the configuration of an air conditioner according to a third exemplary embodiment of the present invention.

Referring FIG. 8, an air conditioner according to the third exemplary embodiment of the present invention comprises a refrigerant circulation flow path 136 which connects the first expansion valve 30 and the second expansion valve 40 and a third heat exchanger 137 which is disposed at the refrigerant circulation flow path 136.

A first refrigerant injection flow path 221 comprises a first heat exchanger 222, which is disposed at the first refrigerant injection flow path 221 for exchanging heat of the refrigerant passing through the first refrigerant injection flow path 221 and heat of the refrigerant passing through the refrigerant circulation flow path 136, and a first refrigerant control valve 223 for throttling the refrigerant passing through the first refrigerant injection flow path 221.

A second refrigerant injection flow path 231 comprises a second heat exchanger 232, which is disposed at the second refrigerant injection flow path 231 for exchanging heat of the refrigerant passing through the second refrigerant injection flow path 231 and heat of the refrigerant passing through the refrigerant circulation flow path 136, and a second refrigerant control valve 233 for throttling the refrigerant passing through the second refrigerant injection flow path 231.

The first heat exchanger 222 and the second heat exchanger 232 and the third heat exchanger 137 are respectively in the shape of a plate. The first heat exchanger 222 and the second heat exchanger 232 and the third heat exchanger 137 are formed in a body. The first heat exchanger 222 is disposed at the one side of the third heat exchanger 137, and the second heat exchanger 232 is disposed at the other side of the third heat exchanger 137.

Because three heat exchangers of plate type are disposed side by side, a structure can be simplified.

Figure 9:
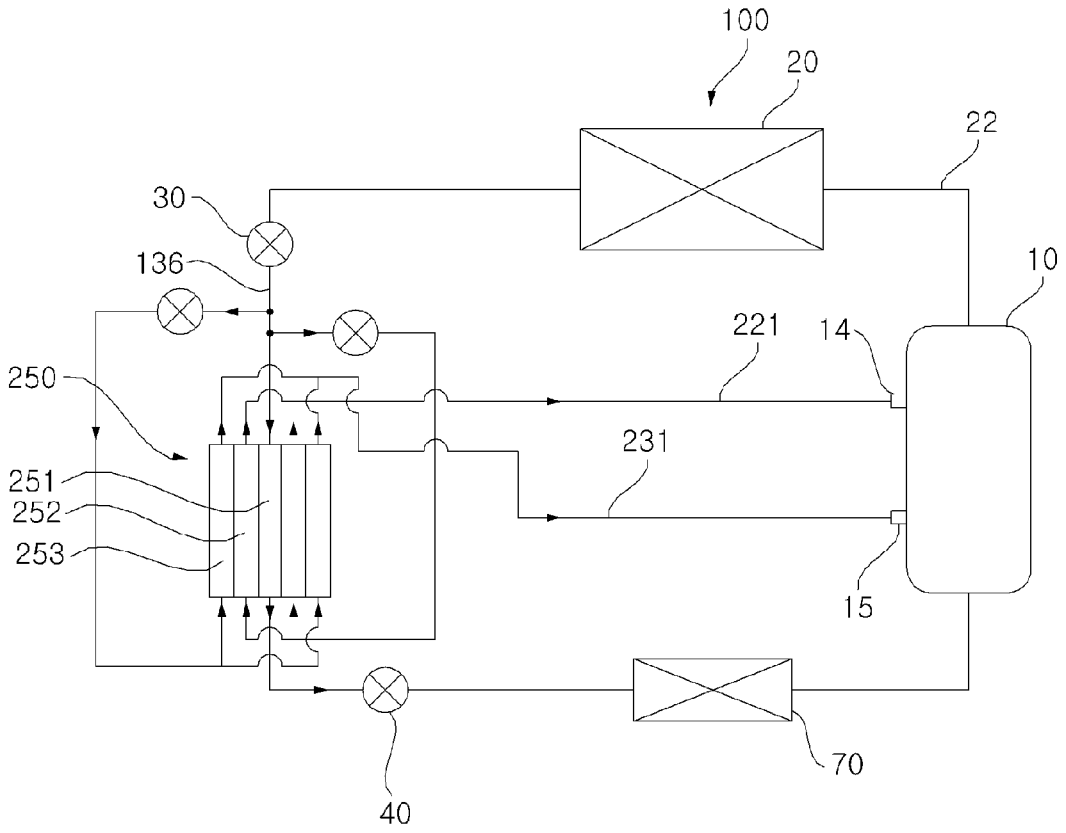
FIG. 9 is a schematic diagram illustrating the configuration of an air conditioner according to a fourth exemplary embodiment of the present invention.
Figure 10:
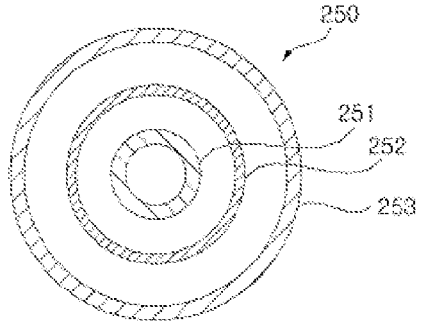
FIG. 10 is a section view illustrating a triple pipe heat exchanger shown in FIG. 9.

FIG. 9 is a schematic diagram illustrating the configuration of an air conditioner according to a fourth exemplary embodiment of the present invention. FIG. 10 is a section view illustrating a triple pipe heat exchanger shown in FIG. 9.

Referring to FIG. 9 and FIG. 10, an air conditioner according to the fourth exemplary embodiment of the present invention comprises a triple pipe heat exchanger 250 which is disposed at the space between the first expansion device 30 and the second expansion device 40. Detailed description about the same elements as the third exemplary embodiment is skipped. A same number in figures indicates the same element.

The triple pipe heat exchanger 250 comprises a first refrigerant pipe 251 forming the first refrigerant injection flow path 221, and a second refrigerant pipe 252 surrounding the first refrigerant pipe 251 and introducing refrigerant passed through the first expansion device 30, and a third refrigerant pipe 253 surrounding the second refrigerant pipe 252 and forming the second refrigerant injection flow path 231.

As stated above, by using the triple pipe heat exchanger 250 comprising the first refrigerant pipe 251 and the second refrigerant pipe 252 and the third refrigerant pipe 253, a structure of the air conditioner can be simplified.

Figure 11:
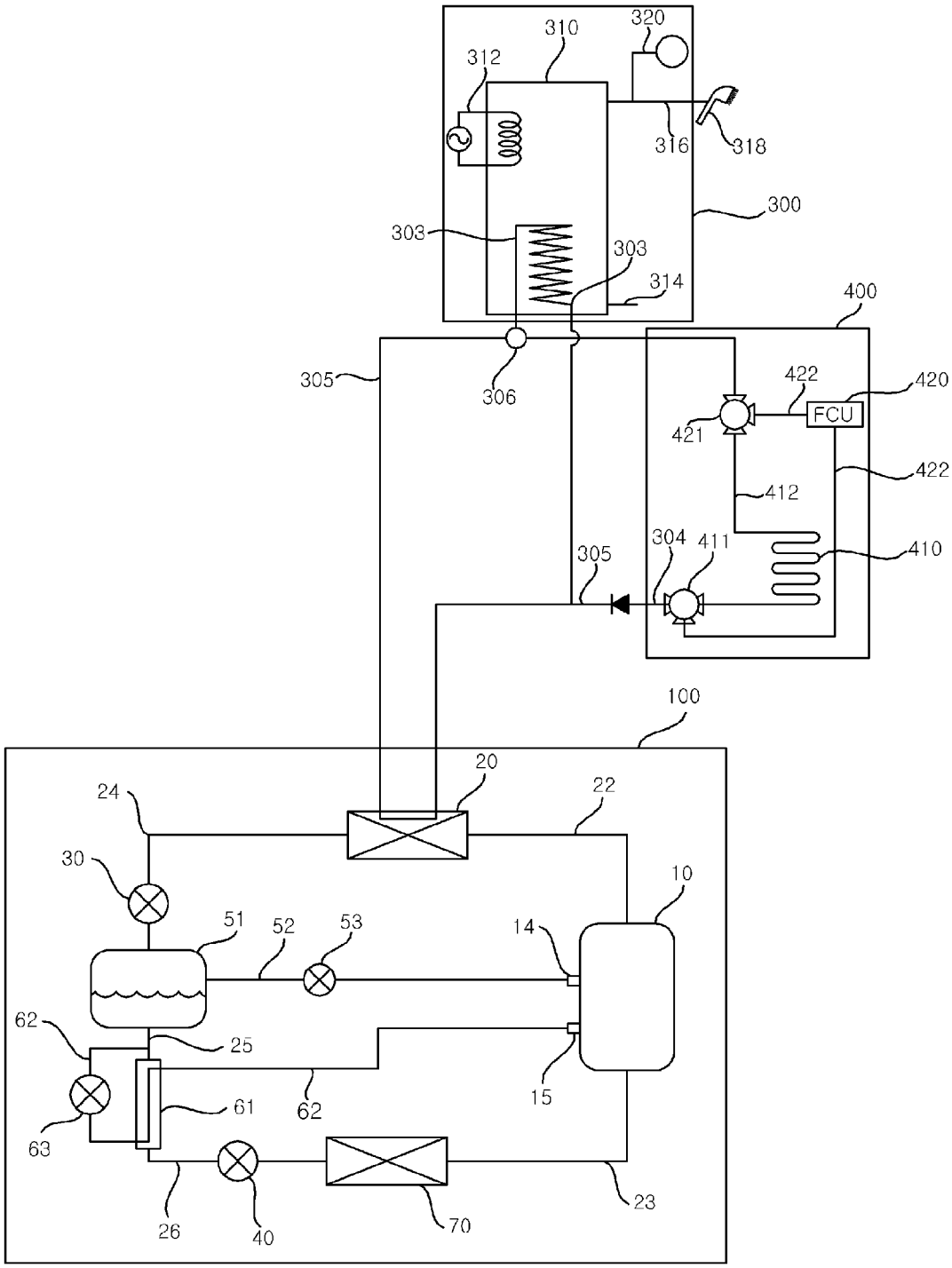
FIG. 11 is a schematic diagram illustrating the configuration of an air conditioner according to a fifth exemplary embodiment of the present invention.

FIG. 11 is a schematic diagram illustrating the configuration of an air conditioner according to a fifth exemplary embodiment of the present invention.

Referring to FIG. 11, a heat pump according to the fifth exemplary embodiment of the present invention comprises an air conditioner 100, and a water heater 300 which uses water heated by the condenser 20 for heating the water, and a heater 400 which uses water heated by the condenser 20 for heating the floor. Detailed description about the same elements as the first exemplary embodiment is skipped. A same number in figures indicates the same element.

The water heater 300 and the heater 400 are connected to the condenser 20 by a hot water circulation flow path 301. The hot water circulation flow path 301 connects the condenser 20 and the water heater 300 and the heater 400 so that hot water heated by the condenser passes through any one of the water heater 300 and the heater 400 and then returns to the condenser 20.

The hot water circulation flow path 301 comprises an indoor unit pipe 302 which is disposed in the inside of the air conditioner 100, and a water heater pipe 303 for introducing a hot water to the water heater 300, and a heater pipe 304 for introducing a hot water to the heater 400, and a connection pipe 305 for connecting the indoor unit pipe 302 to the water heater pipe 303 and the heater pipe 304.

A hot water control valve 306 is installed at the connection pipe 305 for introducing a hot water to any one of the water heater pipe 303 and the heater pipe 304. The water heater 300 is a device for supplying a hot water needed to wash and bath or dish-washing. The water heater 300 comprises a hot water tank 310 for storing water and a sub heater 312 installed in the hot water tank 310.

The hot water tank 310 is connected with a cold water inlet 314 for introducing cold water to the hot water tank 310 and a hot water outlet 316 for discharging hot water.

The hot water outlet 316 may be connected with a hot water discharge apparatus 318 such as a shower. The hot water outlet 316 may be connected with the cold water inlet 320 so as to discharge cold water to the hot water discharge apparatus 318.

The heater 400 comprises a floor heater 410 for heating a floor in the room and an air heater 412 for heating an air in the room.

The floor heater 410 may be laid under the floor by the meander line.

The air heater 412 may comprise a fan coil unit or a radiator.

A hot water control valve for heating 411/421 may be installed at the heater pipe 304 for introducing the hot water to any one of the floor heater 410 and the air heater 420.

The floor heater 410 is connected to the hot water control valve for heating 411 and the floor heating pipe 412, and the air heater 420 is connected to the hot water control valve for heating 421 and the air heating pipe 422.

If the hot water control valve 306 is controlled with a heating mode, the water heated by the condenser 30 passes through the indoor pipe 302 and the connection pipe 305 in order, and heats any one of the floor heater 410 and the air heater 420, and passes through the heater pipe 304 and the connection pipe 305 and the indoor pipe 302 in order, and then is returned to the condenser 20.

If the hot water control valve for heating 411/412 is controlled with a air heating mode, hot water passes through the air heating pipe 422 and the air heater 420 and air heating pipe 422 in order, and is discharged to the heating pipe 304. Meanwhile, if it is controlled with a floor heating mode, hot water passes through the floor heating pipe 412 and the floor heater 411 and the floor heating pipe 412 in order, and is discharged to the heating pipe 304.

In case the heat pump comprises the water heater 300 and the heater 400, refrigerant is also injected through the first refrigerant injection flow path 52 and the second injection flow path 62. Therefore, by injecting refrigerant, a flow rate of the refrigerant can be increased and a performance of the water heating and the heating can be improved.

Although the present invention has been described with reference to the embodiments shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

What is claimed is:

1. A heat pump including at least two refrigerant injection flow paths into a scroll compressor, the heat pump comprising:

a main circuit which comprises the scroll compressor, a condenser for condensing refrigerant passed through the scroll compressor, an expansion valve for expanding the refrigerant passed through the condenser, a phase separator for separating the refrigerant into liquid refrigerant and vapor refrigerant, and an evaporator for evaporating refrigerant, wherein the scroll compressor is provided with a first refrigerant injection port between an inlet of the scroll compressor and an outlet of the scroll compressor, and a second refrigerant injection port between the inlet and the first refrigerant injection port;

a first refrigerant injection flow path, which is bypassed from the phase separator and is connected to the first refrigerant injection port of the scroll compressor;

an internal heat exchanger installed between the phase separator and the evaporator;

a second refrigerant injection flow path, which is bypassed between the phase separator and the internal heat exchanger, and is connected to the second refrigerant injection port of the scroll compressor wherein the second refrigerant injection flow path is passed through the internal heat exchanger.

2. The heat pump of claim 1, wherein the expansion valve comprises a first expansion valve which is disposed between the condenser and the phase separator, and a second expansion valve which is disposed between the internal heat exchanger and the evaporator.

3. The heat pump of claim 1, wherein a refrigerant control valve is installed at the second refrigerant injection flow path to throttle the refrigerant before flowing into the internal heat exchanger.

4. The heat pump of claim 3, wherein the internal heat exchanger comprises a first refrigerant pipe and a second refrigerant pipe which is formed to surround the first refrigerant pipe, and one of the refrigerant flowing into the evaporator and the refrigerant injecting into the scroll compressor passes through the first refrigerant pipe and the other refrigerant of those passes through the second refrigerant pipe.

5. The heat pump of claim 1, wherein the expansion valve comprises a first expansion valve installed between the condenser and the phase separator, and a second expansion valve installed between the internal heat exchanger and the evaporator, wherein, a first refrigerant control valve, is installed at the first refrigerant injection flow path and a second refrigerant control valve is installed at the second refrigerant injection flow path, and further comprising a controller which controls opening degrees of the first refrigerant control valve and the second refrigerant control valve.

6. The heat pump of claim 5, wherein the controller controls that the first refrigerant control valve and the second refrigerant control valve are opened at a same time according to a heating load of the heat pump.

7. The heat pump of claim 5, wherein the controller controls that the opening degree of the second expansion valve is larger than or equal to the opening degree of the first expansion valve.

8. The heat pump of claim 5, wherein when the heat pump is started, the controller controls that the first and second expansion valves are started to open and the first and second refrigerant control valves are closed, and then, if the refrigerant injection is demanded after first and second expansion valves are opened, the controller controls that at least one of the first refrigerant control valve and the second refrigerant control valve is opened.

9. The heat pump of claim 8, wherein the controller controls that the first refrigerant control valve and the second refrigerant control valve are opened in sequence according to a heating load of the heat pump.

10. The heat pump of claim 1, further comprising a water heater and a heater which are connected to the condenser by a hot water circulation flow path, wherein the water heater comprises a hot water tank for containing hot water, and the heater comprises an air heater for heating an air in a room, wherein a control valve is installed at the hot water circulation flow path to introduce the hot water heated in the condenser into at least one of the water heater and the heater.

* * * * *